United States Patent [19]

Shields

[11] Patent Number: 4,936,243

[45] Date of Patent: Jun. 26, 1990

[54] TRANSOM RUDDER SEAT

[76] Inventor: Terry Shields, 1602 San Saba, Bossier City, La. 71112

[21] Appl. No.: 340,664

[22] Filed: Apr. 20, 1989

[51] Int. Cl.[5] ..... B63B 17/00

[52] U.S. Cl. ..... 114/363; 114/127

[58] Field of Search ..... 114/39.1, 126, 127, 114/128, 140, 144 R, 162, 163, 363, 364; 441/72, 67, 130

[56] References Cited

U.S. PATENT DOCUMENTS 277,667 5/1883 Blanchard ..... 114/144 R 2,525,933 10/1950 Nantz ..... 114/364

FOREIGN PATENT DOCUMENTS 3612985 10/1987 Fed. Rep. of Germany ..... 114/363

*Primary Examiner*—Joseph F. Peters, Jr.

*Assistant Examiner*—Jesûs D. Sotelo

*Attorney, Agent, or Firm*—John M. Harrison

[57] ABSTRACT

This invention is a transom-mounted combination casting seat and anti-drift fin, herein called a transom fin seat. The transom fin seat includes a fin stem, a fin deployed at the bottom of the fin stem, a rigid or pivoting casting seat affixed to the top of the fin stem and a mounting mechanism affixed to the fin stem for securing the transom fin seat to the transom of a boat. In a preferred embodiment, the mounting mechanism is characterized by a transom bracket attached to the fin stem and adapted for engaging the boat transom. In a most preferred embodiment, the transom bracket includes one or more screw-type clamps for removably clamping the transom bracket to the boat transom.

14 Claims, 1 Drawing Sheet

TRANSOM RUDDER SEAT

BACKGROUND OF THE INVENTION

Field of the Invention

This invention relates to a multi-purpose, removable seat accessory for bass fishing boats. More specifically, the invention relates to a transom-mounted combination casting seat and anti-drift fin, herein called a transom fin seat.

The trolling motor has become one of the modern fisherman's most valued assets, since it allows the fisherman to glide along silently while casting and fishing. Moreover, in some lakes where pollution and noise control is strictly maintained, the trolling motor is the anglers only means of automatic propulsion. In order to maximize efficiency, trolling motors are usually bow-mounted, thus it pulling the boat along in generally a straight line. However, there is sometimes a problem of drift due to current and wind and under circumstances where an outboard motor is used to drive the boat at higher speeds, the outboard motor is usually oriented in angular relationship on the boat transom when not in use. This motor orientation presents the lower unit in the water at an angle, thereby causing the boat to "pull" in the direction of tilt of the outboard motor. Under these circumstances, deployment of an anti-drift rudder is helpful in alleviating the problem. Such a rudder is described in U.S. Pat. No. 4,211,180, issued to James C. Brooks, Jr., on Jul. 8, 1980, which details a compensating trolling fin that is adapted to be secured to the transom of a boat. The transom includes a J-shaped frame, a two-piece, pivoted linkage arm coupled to the frame, a blade secured to the linkage for deployment in the water to resist drifting and a slot defined within the frame for snugly receiving a portion of the blade to reinforce the trolling fin when the blade is deployed.

Yet another well accepted accessory in equipping bass boats is the casting seat, a chair which is usually elevated above the deck of the boat by means of a pedestal and is equipped to swivel to the fisherman's desired position. The invention described in this application embodies both the stabilizing fin and the casting seat in one readily-removable accessory.

The expense of today's bass rigs, as well as the rigid demands of the modern enthusiastic fishermen, dictates that bass boats and related fishing and boating equipment be as versatile and portable as possible. Often, a single boat must serve both as a bass rig and general pleasure craft and this dual identity sometimes requires that various accessories, such as seats, be completely and easily removable. Prior art stabilizer rudder assemblies must be at least semi-permanently attached by a screw clamp or other locking means and serve the sole purpose of steering the boat. In a preferred embodiment the transom fin seat described herein (after adjustments are made for the transom size and shape) is held in place primarily by virtue of the shape of its mounting assembly and the weight of the fisherman seated in the attached casting seat. This allows the stabilizer fin assembly or transom fin seat to be quickly and easily moved to selected positions along the boat's transom and to be removed and stored at will. In another preferred embodiment, one or more screw-type clamps are added to the mounting assembly for securing the transom fin seat to the boat transom.

Another feature of the transom fin seat of this invention is the provision of an additional casting seat, a feature which allows a bass rig to accommodate an extra fisherman, and placement of the additional casting seat directly over the transom also offers several advantages. The stern is one of the more stable points in a boat and location of the casting seat directly over the transom allows a great degree of flexibility in the fisherman's position, while maximizing the distance between the anglers in the boat. This provides a great improvement in convenience and safety in casting, particularly in small boats. Furthermore, the angler occupying the stern of the boat is allowed to cast in a rearward direction without casting directly over the outboard motor. In view of such advantages as greater stability, removability, convenience and safety, it is evident that the transom fin seat of this invention provides a much needed and well-accepted accessory in the sport of angling.

BRIEF DESCRIPTION OF THE DRAWING

The invention will be better understood by reference to the accompanying drawing, wherein.

Detailed Description

Figure 1:
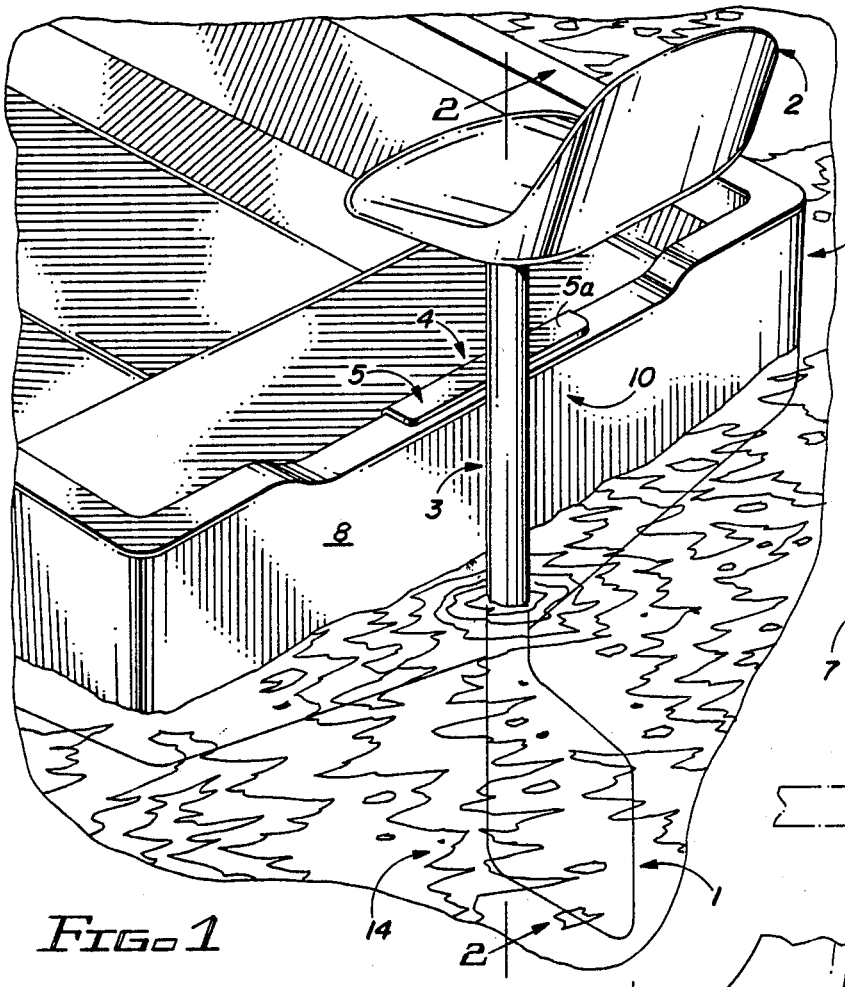
FIG. 1 is a perspective view of the transom fin seat of this invention, showing the fin stem, seat and fin.

Referring to FIG. 1 of the drawing, a preferred embodiment of the transom fin seat of this invention is generally illustrated by reference numeral 10 and includes a fin 1, a casting seat 2, a fin stem 3 connecting the fin 1 to the casting seat 2 and a transom mounting assembly 4. In a first preferred embodiment the transom mounting assembly 4 consists of an inverted L-shaped bracket 5, having a top flange **5*a* and a bottom flange 5*b*. The fin 1 is suitably affixed to, or is integrally formed with the lower end of the fin stem 3, for deployment in the water 14. The edge of the top flange 5*a* of the L-shaped transom bracket 5 is welded or otherwise affixed to the mid-section of the fin stem 3, while the bottom flange 5*b* of the transom bracket 5 projects downwardly, generally parallel to the fin stem 3. The space between eh bottom flange 5*b* and the fin stem 3 is slightly greater than the width of the transom 8 of the boat 9, in order to snugly, but removably, receive the transom 8**.

Figure 2:
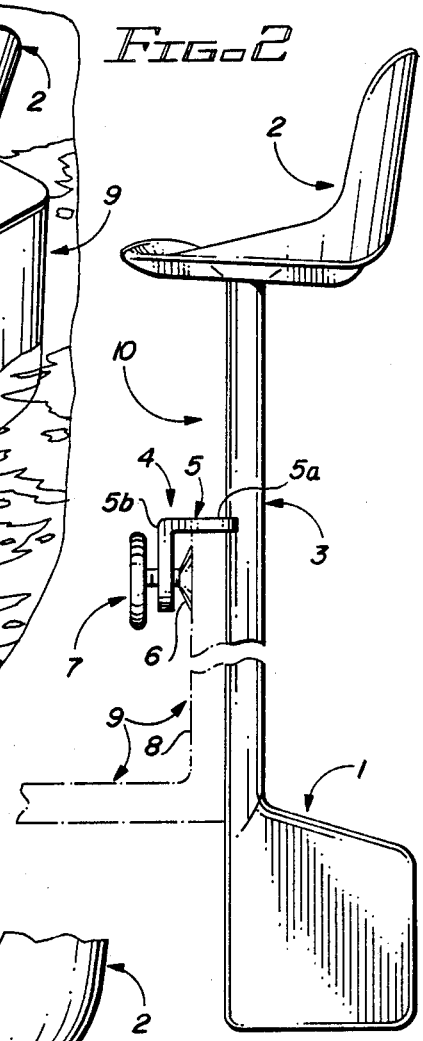
FIG. 2 is a side elevation of the transom fin seat illustrated in FIG. 1 with a pair of screw-type clamps added to the transom mounting assembly.
Figure 3:
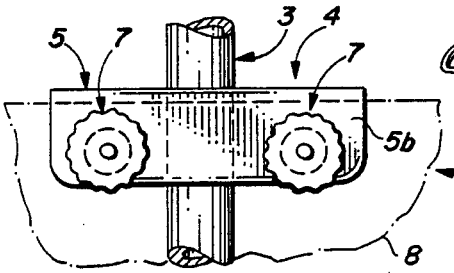
FIG. 3 is a front sectional view of the transom mounting assembly illustrated in FIG. 2.
Figure 4:
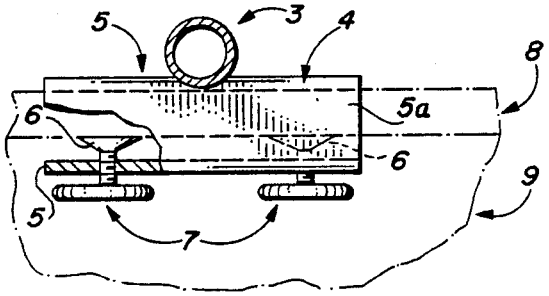
FIG. 4 is a top view, partially in section, of the transom mounting assembly illustrated in FIG. 3.

Referring now to FIGS. 2–4, a pair of screw clamps 7 are threadably mounted in the bottom flange **5*b* of the transom bracket 5 in spaced relationship and the companion clamp washers 6 can be tightened against the transom 8 to further secure the transom fin seat 10 on the transom 8. Furthermore, it can be seen that the fin stem 3 is mounted in an essentially vertical position to the transom 8 by operation of the transom mounting assembly 4. The fin 1 is deployed beneath the surface of the water 14 in the directional plane of the boat 9, thus minimizing "drift" and "pull" of the boat to either side of the direction of motion. The space between the bottom flange 5b of the L-shaped bracket 5 and the fin stem 3 which receives the transom 8, is somewhat larger than that provided in the FIG. 1 embodiment of the transom bracket 5, in order to accommodate the clamp washers 6 which engage the transom 8. The casting seat 2 is mounted on the elevated end of the fin stem 3 in either fixed or pivotal relationship and due to the optional rearward tilt of the transom 8 (a feature which is common in boat design), the fin stem 3 may also be tilted slightly rearwardly. The casting seat 2 may therefore be mounted at a slightly forward angle with respect to the fin stem 3, if desired, thus compensating for the rearward tilt of the fin stem 3. Due to such a rearward tilt of the fin stem 3, the downward pressure exerted by the combined weight of the casting seat 2 and a seated fisherman (not illustrated), creates a binding force upon the mounting assembly 4, thus helping to secure the transom fin seat 10 in place on the transom 8, under circumstances where the screw-type clamps 7 are not used in the transom mounting assembly 4. Alternatively, the transom fin seat 10 may be secured by only one screw-type fastening clamp 7 and a companion clamp washer 6 to prevent the transom fin seat 10 from tilting. Thus, the transom fin seat 10 may be quickly deployed on the transom 8 of the boat 9**, as a combination casting seat and anti-drift fin.

Figure 5:
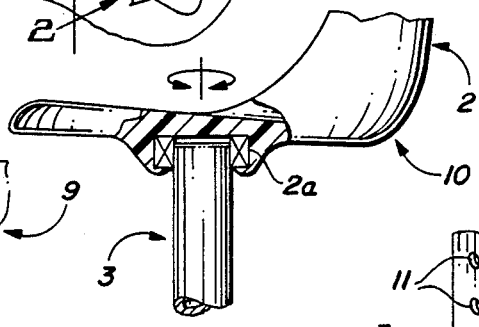
FIG. 5 is a side view, partially in section, of a casting seat rotatably mounted on the fin stem.

Referring now to FIG. 5 of the drawing, in a preferred embodiment of the invention a seat bearing 2a is mounted in the casting seat 2 to receive the top end of the fin stem 3, in order to facilitate rotation of the casting seat 2 with respect to the fin stem 3. Furthermore, referring to FIG. 6, in another preferred embodiment, the fin stem 3 is shaped from square tubing and is divided into a seat segment 3a and a fin segment 3b, which seat segment 3a is further provided with spaced adjusting holes 11. An adjusting pin 12, fitted with a pin ring 13 at one end, is inserted in a companion adjusting hole 11, provided in the fin segment 3b, and is then extended through a selected one of the spaced adjusting holes 11, located in the telescoping seat segment 3a, to adjust the height of a casting seat (not illustrated) which may be mounted on the upper end of the seat segment 3a. Moreover, the round knobs provided in the screw-type clamps 7 have been replaced by L-shaped bars in yet another alternative preferred embodiment of the invention.

Figure 6:
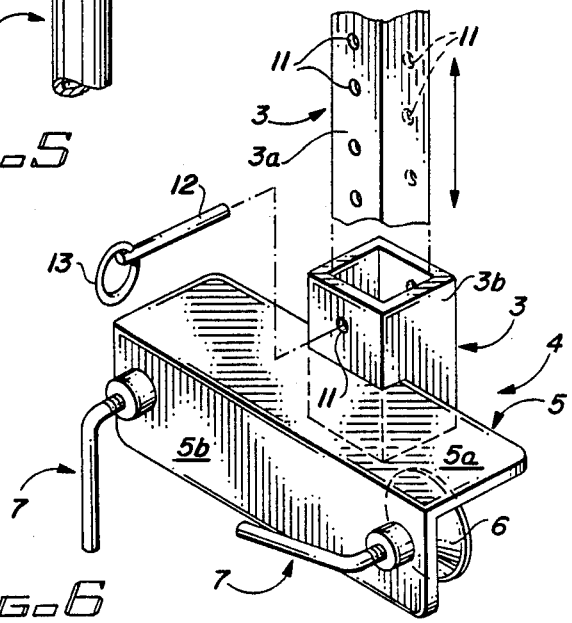
FIG. 6 is a perspective view of an alternative telescoping fin stem provided in the transom mounting assembly illustrated in FIGS. 1 and 2.

Referring again to the drawings, it will be appreciated that the fin stem 3 can be constructed of substantially any desired structural material, including the round rubbing illustrated in FIGS. 1–5 and the square tubing illustrated in FIG. 6, as well as other selected stock, such as angle iron and the like, in non-exclusive particular. Furthermore, the fin 1 can be constructed of such materials as wood, fiberglass or metal, as desired, and the casting seat 2 is most preferably molded from a plastic material according to the knowledge of those skilled in the art. Moreover, while a pair of screw-type clamps 7 are illustrated in FIGS. 2–6 of the drawing, it is understood that a single screw-type clamp 7 may be utilized, as deemed necessary, in that embodiment of the invention which utilizes the screw clamp 7.

While the preferred embodiments o the invention have been described above, it will be recognized and understood that various modifications may be made therein and the appended claims are intended to cover all such modifications which may fall within the spirit and scope of the invention.

Having described my invention with the particularly set forth above, what is claimed is:

1. A transom fin seat for a boat having a transom, comprising:

(a) an elongated fin stem having a mid-section, an elevated end and a bottom end, said bottom end adapted for submerging when said fin stem is mounted on the transom of the boat;

(b) a seat carried by said elevated end of said fin stem;

(c) a fin carried by said bottom end of said fin stem; and (d) an inverted "L"-shaped bracket, said bracket having a top flange and a bottom flange, with said top flange fixedly secured to said mid-section of said fin stem and said bottom flange projecting downwardly substantially parallel with respect to said fin stem, for engaging said transom and mounting said fin stem and said seat on the transom of the boat.

2. The transom fin seat as recited in claim 1 further comprising at least one screw-type fastener clamp threadably carried by said bottom flange of said "L"-shaped bracket, for clamping said bracket to the transom.

3. The transom fin seat of claim 1 wherein said seat is rotatably attached to said elevated end of said fin stem.

4. The transom fin seat of claim 1 further comprising at least one screw-type fastener clamp threadably carried by said bottom flange of said "L"-shaped bracket, for clamping said bracket to the transom.

5. The transom fin seat of claim 1 wherein said seat is fixedly attached to said elevated end of said fin stem.

6. The transom fin seat of claim 1 wherein said fin stem further comprises a first stem segment carrying said transom fin and a second stem segment carried by said first stem segment in adjustable, telescopic relationship, for adjusting the height of said seat above the transom.

7. The transom fin seat of claim 6 wherein said seat is rotatably attached to said elevated end of said fin stem.

8. The transom fin seat of claim 10 further comprising at least one screw-type fastener clamp threadably carried by said bottom flange of said "L"-shaped bracket, for clamping said bracket to the transom.

9. The transom fin seat of claim 8 wherein said seat is rotatably attached to said elevated end of said fin stem.

10. The transom fin seat of claim 9 further comprising at least one screw-type fastener clamp threadably carried by said bottom flange of said "L"-shaped bracket, for clamping said bracket to the transom.

11. The transom fin seat of claim 6 wherein said seat is fixedly attached to said elevated end of said fin stem.

12. A transom fin seat for a boat having a transom comprising:

(a) an elongated fin stem having a mid-section, an elevated end and a bottom end, said bottom end adapted for submerging when said fin stem is mounted on the transom of the boat;

(b) a seat carried by said elevated end of said fin stem;

(c) a fin carried by said bottom end of said fin stem;

(d) an inverted, generally L-shaped bracket having a top flange and a bottom flange, with the edge of said top flange fixedly secured to said mid-section of said fin stem and said bottom flange projecting downwardly substantially parallel with respect to said fin stem, for engaging said transom and mounting said fin stem and said seat on the transom of the boat; and (e) at least one screw-type fastener clamp threadably carried by said bottom flange of said "L-shaped" bracket, for clamping said bracket to the transom.

13. The transom fin seat of claim 12 wherein said seat is rotatably attached to said elevated end of said fin stem.

14. The transom fin seat of claim 12 wherein said seat is fixedly attached to said elevated end of said fin stem.

* * * * *